US007487653B2

(12) United States Patent
Widén

(10) Patent No.: US 7,487,653 B2
(45) **Date of Patent: *Feb. 10, 2009**

(54) LOCK AND KEY SYSTEM WITH EXTRA CODE COMBINATIONS

(75) Inventor: Bo Widén, Torshälla (SE)

(73) Assignee: Winloc AG, Schweiz (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/591,634

(22) Filed: Nov. 2, 2006

(65) Prior Publication Data

US 2007/0051147 A1 Mar. 8, 2007

Related U.S. Application Data

(63) Continuation of application No. 10/913,519, filed on Aug. 9, 2004, now Pat. No. 7,159,424.

(60) Provisional application No. 60/504,202, filed on Sep. 22, 2003.

(51) Int. Cl.
*E05B 19/06* (2006.01)
*E05B 27/10* (2006.01)

(52) U.S. Cl. ..... 70/409; 70/494; 70/495

(58) Field of Classification Search ..... 70/405–407, 70/409, 492–495

See application file for complete search history.

(56) References Cited

U.S. PATENT DOCUMENTS 3,603,123 A 9/1971 Best
4,756,177 A 7/1988 Widen
4,815,307 A 3/1989 Widen
5,000,019 A 3/1991 Foster
5,067,335 A 11/1991 Widén
5,640,865 A 6/1997 Widen
5,715,717 A 2/1998 Widen
5,809,816 A 9/1998 Widen
5,845,525 A 12/1998 Widen
6,134,929 A 10/2000 Widen
6,481,255 B2 * 11/2002 Theriault et al. ..... 70/495
7,159,424 B2 * 1/2007 Widen ..... 70/409

* cited by examiner

*Primary Examiner*—Lloyd A Gall
(74) *Attorney, Agent, or Firm*—Birch, Stewart, Kolasch & Birch, LLP

(57) ABSTRACT

A high security lock and key system with an increased number of code combinations wherein the blade of the key has a wave-like guiding surface at the side of the key blade which, upon insertion into an associated lock having a rotatable key plug, engages with one or more side locking tumblers in the lock cooperating with a side locking mechanism for locking the key plug against rotation. In order to provide an even higher number of possible code combinations, while preserving the overall dimensions of the locks and the keys of the system, an extra code level located at a longitudinally extending shelf surface, viz. at the upper boundary of the side material region where the wave-like guiding surface is cut at the side of the key blade. The invention also relates to a key and a key blade and to a lock for use in such a system.

1 Claim, 6 Drawing Sheets

Fig. 15
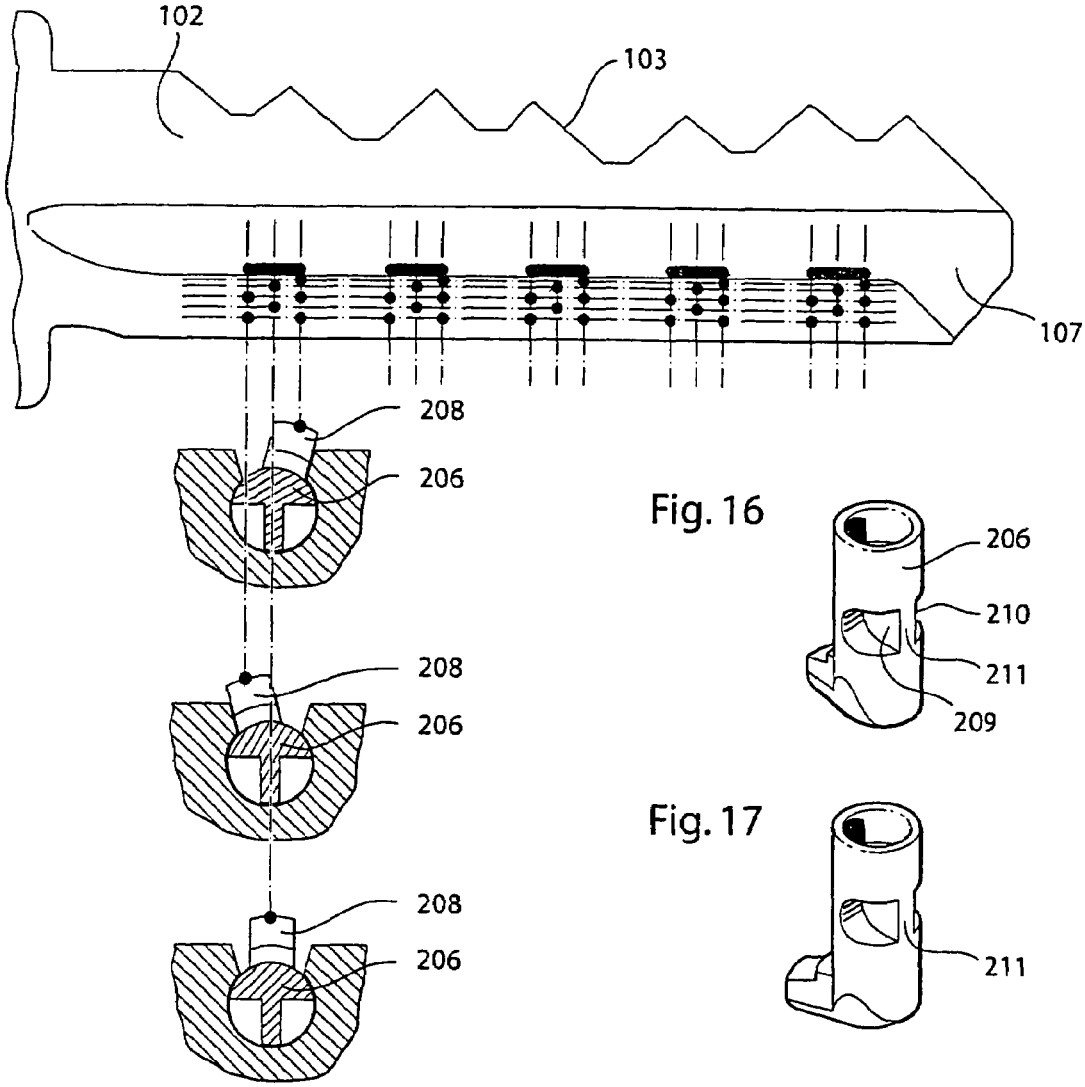
Fig. 16
Fig. 17
Fig. 18
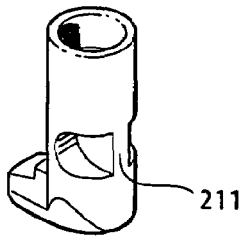
Fig. 19
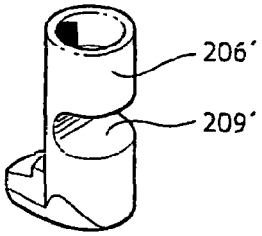

LOCK AND KEY SYSTEM WITH EXTRA CODE COMBINATIONS

The present application is a continuation application of application Ser. No. 10/913,519, filed on Aug. 9, 2004, now U.S. Pat No. 7,159,424, issued on Jan. 9, 2007, which claimed priority of U.S. Provisional Patent Application Ser. No. 60/504,202, filed on Sep. 22, 2003.

FIELD OF THE INVENTION

The present invention relates to a high security lock and key system with an increased number of code combinations. The system is of the kind where the blade of the key has a wave-like guiding surface at the side of the key blade which, upon insertion into an associated lock having a rotatable key plug, engages with one or more side locking tumblers cooperating with a side locking mechanism for locking the key plug against rotation. Such lock and key systems are generally known from the U.S. Pat. Nos. 4,756,177 and 5,715,717 (both in the name of Bo Widén).

The invention also relates to a key and a key blade as such, and to a lock as such, for use in such a system.

More particularly, the present key for use in a lock and key system comprises:

a longitudinally extending key blade (102), which is insertable into said key slot (201) of the key plug of an associated lock, said key blade having a side material region at one side of said key blade defined upwardly by a longitudinally extending shelf surface, which is at least partially interrupted by a side code pattern cut into said material region so as to form a wave-like guiding surface (105) including a ramp surface portion (106) at the free end portion (107) of the key blade, said wave-like guiding surface (105) engaging with a finger of said at least one side locking tumbler of said associated lock and making said finger follow said wave-like guiding surface, while the side locking tumbler is moved elevationally and the finger (208) is caused to pivot sideways between said pivotal end positions, when the key blade is inserted into the key slot, said wave-like guiding surface including at least one side code portion (122,123,124,125) associated with said side locking tumbler (206) and guiding the finger (208) thereof, upon fully inserting the key blade into the key slot, into a specific position, causing the locking tumbler to allow said side locking means to release the key plug relative to said housing, said at least one side code portion (122,123,124,125) being located at a selected one of a predetermined number of vertical code levels and at a selected one of a predetermined number of longitudinal positions, characterized in that in addition to said number of vertical code levels for said at least one side code portion, there is an extra code level located near said shelf surface, and there being provided at least one longitudinally extending, extra side code segment (121) located at this extra code level, said extra side code segment having a predetermined length for forming a supporting surface portion with sufficient friction to position the associated finger in a correct pivotal orientation, whereby the number of possible code combinations is increased.

BACKGROUND OF THE INVENTION

Such lock and key systems of the kind known from the above mentioned US patents (Bo Widén) provide a high level of security as compared to conventional systems without rotatable tumblers and pivoting fingers thereon. A great number of code combinations can be achieved, and the locks are very difficult to pick or manipulate. The tumblers are only partially visible in the key slot, and their correct elevational and pivotal code positions are hidden from inspection through the key slot. Therefore, the particular code positions cannot be determined from just observing the key slot or even by sensing the finger positions with a tool.

The side code portions of the wave-like guiding surface (sometimes also called side bitting) of the key blade of the previously known key are each constituted by a concavity surface portion having two upwardly sloping surface portions adjoining smoothly on each longitudinal side thereof. These concavity surface portions can be located at a number of predetermined vertical levels at the side of the key blade. More specifically, it follows that the highest vertical level for the side code portions will be located at a vertical level which is somewhat lower than the uppermost part of the side material region where the wave-like guiding surface is cut, so as to accommodate the vertical extension of the adjoining sloping portions. A typical prior art key of this kind is shown in FIG. 28.

The possible number of side code portions associated with a particular side locking tumbler for a code structure involve different combinations of predetermined vertical levels and a number of longitudinal positions in relation to the side locking tumbler. In a typical system, which has been in commercial use for many years, the number of side tumblers is five (in addition to six centrally located tumblers cooperating with an upper edge of the key blade). The side material region, where the wave-like guiding surface or side bitting is cut at the side of the key blade, has a relatively small height (perpendicularly to the longitudinal direction of the key blade), such as about 2.0 mm (about 0.080 inches). Therefore, only a limited number of vertical levels can be accommodated while clearly differentiating between different codes, in particular two such levels, 0.60 mm (0.024 inches) and 1.20 mm (0.048 inches), respectively, calculated from the bottom edge of the key blade.

Such differentiated levels pertain to a particular pivotal position of the finger of the associated side locking tumbler. In the embodiment used hitherto, there are two vertical levels corresponding to each pivotal end position of the finger (at a pivotal angle of +15° and −15°), and two further levels corresponding to an intermediate pivotal position (at a pivotal angle of 0°), each being slightly higher than the first-mentioned levels, viz. 0.90 mm (0.036 inches) and 1.50 mm (0.060 inches), respectively. The reason why the vertical levels of the code portions at the 0° pivotal angle are somewhat higher than those at the pivotal end position angles is that the difference or mutual distance between the adjacent pivotal positions is too small to give a clearly differentiated code. The difference becomes greater when the vertical level as well as the longitudinal position are different.

Accordingly, for each side locking tumbler in the example above, there are six possible codes, viz.

- two code portions at different vertical levels corresponding to a pivotal end position at +15°
- two code portions at different vertical levels corresponding to a pivotal end position at −15°, and
- two portions at different, slightly higher vertical levels corresponding to an intermediate pivotal position, making a total of six possible code portions for each side locking tumbler or a total of $6^5$=7776 different combinations.

Of course, it would be desirable to even further increase this relatively high number of combinations. However, the dimensions of the keys are greatly standardized and also adapted to existing manufacturing facilities. So, the only possibilities seem to be to either pack the vertical levels closer together, which would mean too short a vertical difference of less than 0.50 mm (0.020 inches) between such packed levels, or to use more than three different pivotal positions, which is however also not possible because of the very small longitudinal differences that would follow from such a modification.

OBJECT OF THE INVENTION

Against this background, a main object of the present invention is to provide an even higher security against copying the key or picking the lock, and to provide a lock and key system with an even higher number of possible code combinations, while preserving the overall dimensions of the locks and the keys of the system. A further object is to enable a highly controlled manufacture of keys and key blanks, so that the users of the lock and key system can remain confident that a particular key is unique and cannot be readily duplicated by unauthorised persons.

SUMMARY OF THE INVENTION

These objects are achieved for a cylinder lock and key system having the features stated in claim 1. Accordingly, in addition to the number of vertical code levels being used hitherto in such lock and key systems, the present invention provides for an extra code level located at the longitudinally extending shelf surface itself, viz. at the upper boundary of the side material region where the wave-like guiding surface or side bitting is cut at the side of the key blade. Thanks to this extra code level, the number of code combinations will be increased considerably, in the example discussed above, from six to seven code combinations for each side locking tumbler, and from 7776 to 16807 combinations in case there are five side locking tumblers in a row. The increase is more than double the previous number and provides 9031 additional combinations, or even a still higher number in some embodiments. These additional combinations can be used in future lock and key systems, thus enabling a controlled manufacturing and distribution of key blades to the end users of the systems. In this way, a very high security against unauthorised copying of keys can be maintained, even for future systems using these additional combinations.

It is also possible to cut new keys for existing lock installations, where the new side code pattern would include at least one additional code portion at the extra code level. In the existing lock installation, the cylinder side combination could be changed by using common and normal combination techniques, i.e. by replacing an existing tumbler by a new tumbler adapted to operate at the extra code level. In this way, existing installations can easily be upgraded so as to make use of the new 9,031 combinations.

The inventive concept is based on the insight that even the longitudinal shelf surface, at the upper boundary of the side material region accommodating the side bitting, can be utilized as a side code portion in spite of the fact that it does not enable the provision of adjoining sloping portions adjacent to a concavity and it may not uniquely define a pivotal position of the associated tumbler finger. For the code portions located at lower levels and having adjoining sloping portions, and thus defining a concavity location as disclosed in detail in the US patents referred to above, it is possible to allocate different side code portions to the particular pivotal positions, but such a differentiated code allocation is generally not possible for a side code top segment having no adjoining sloping portions. Nevertheless, such a side code top segment is unique in respect of its vertical level, and it is therefore possible to allocate a specific code to this side code top segment, irrespective of the particular pivotal position which may be assumed by the associated tumbler finger.

However, it has also turned out in practice that the finger of a rotatable side tumbler will always be oriented in a certain pivotal position if it is slid upwards (while the key blade is inserted into the lock) on a sloping portion onto a side code top segment forming a part of the longitudinally extending shelf surface. When the finger climbs such a slope, the finger will be guided so that its free end portion will point towards the free end or tip of the key blade. When moving on to the adjoining side code top segment, which is substantially flat, the finger will be retained in this particular pivotal position, even after completion of the insertion movement of the key blade into the key slot of the lock.

One would think that the finger would pivot back and forth randomly when it has reached a flat side code top segment. However, the mass of the finger is very small as compared to the tumbler body itself. The finger can only pivot if the tumbler body is rotated about its axis in the associated chamber. Even if the lock is subjected to vibrational or other random movements, there will be no torque acting on the tumbler body which would make it rotate. Moreover, since the tumbler body is subjected to a force, e.g. by a spring, there is a certain friction at the contact point between the finger and the surface of the flat side code top segment. This explains why the finger will in effect be retained in its particular position, viz. the pivotal end position pointing towards the tip of the key blade.

So, there is not an absolute need for any stop or holding means on the flat side code top segment. Nevertheless, to be on the safe side and to rule out the unlikely event that the finger would move from its position, it is preferable to geometrically form the flat side code top segment with a relatively shallow holding structure which will positively hold the finger in its pivotal position, as long as the key blade remains in its inserted position in the key slot of the lock.

The extra code level can be used at any longitudinal position along the key blade, i.e. for any one of a number of side locking tumblers in a row. For each such side code top segment, the finger of the associated side locking tumbler will automatically be positioned and retained in a pivotal end position pointing towards the tip of the key blade, as explained above.

Many advantageous embodiments are defined in the claims and will be apparent from the detailed description below.

The invention can be used in combination with other kinds of locking mechanisms and key code patterns, e.g. of the kind disclosed in the U.S. Pat. No. 5,067,335 (Widén) or any other kind.

In order to provide an even higher number of additional code combinations, it is possible to use both rotatable and non-rotatable locking tumblers in a lock and key system. By using non-rotatable (but elevationally movable) locking tumblers together with rotatable and elevationally movable locking tumblers in some locks of the system, such non-rotatable locking tumblers may be provided with fingers adapted to cooperate with a side code top segment at a rear end position displaced away from the tip of the associated key blade, and also at other code locations in order to maintain a high level of security. Hereby, it is effectively possible to obtain one further code position for each tumbler, i.e. an $8^{th}$ code position.

BRIEF DESCRIPTION OF THE DRAWINGS

The invention will now be described more fully with reference to the attached drawings which illustrate some preferred embodiments of the lock and key system according to the invention.

FIG. 15 shows, in a schematic side view, a key blade according to the invention, indicating the locations, represented by black dots, of possible side code portions for each side locking tumbler;

FIGS. 16, 17 and 18 show, in perspective views, side locking tumblers of the kinds indicated in FIG. 15, with fingers pointing in different directions;

FIG. 19 shows, in a perspective view, a side locking tumbler designed to be positioned in any rotational position;

DETAILED DESCRIPTION OF SOME PREFERRED EMBODIMENTS

Figure 28:
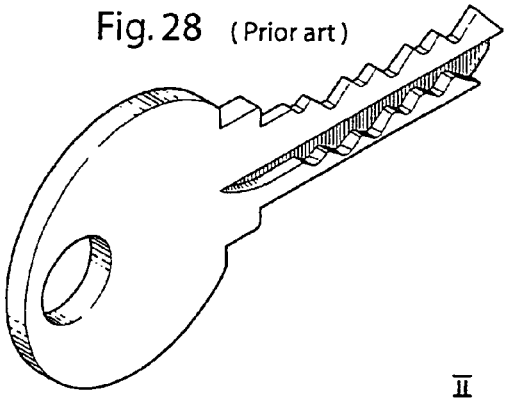
Fig. 28 (Prior art)
FIG. 28 shows, in a perspective view, a prior art key with a wave-like side code pattern having a number of concavity surface portions serving as code portions.
Figure 1:
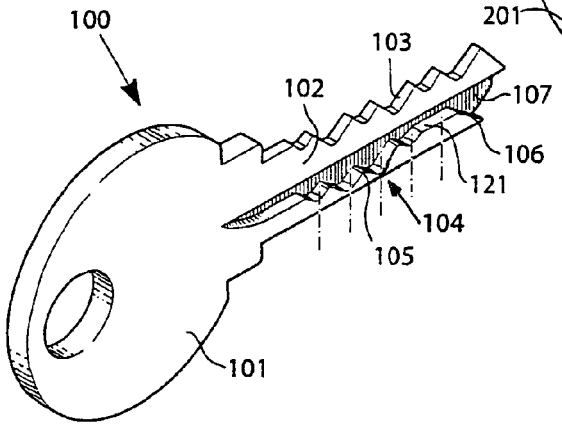
FIG. 1 shows, in a perspective view, a key and a cylinder lock, the latter being partially cut away for greater clarity.
Figure 1:
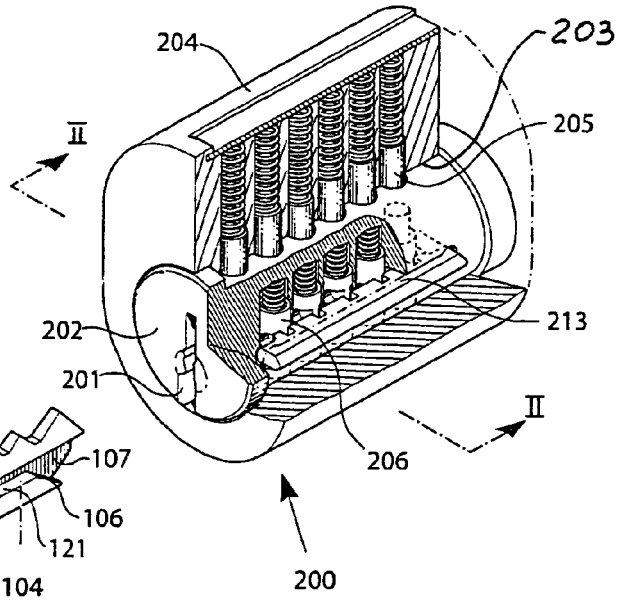

In FIG. 1, there is shown a cylinder lock and a key included in a system according to the invention. The key 100 has a grip portion 101 and a key blade 102, which is insertable into a key slot 201 of the lock 200. The key slot 201 extends longitudinally in a key plug 202 which is rotatably journalled in a cylindrical bore 203 in a housing 204.

In this embodiment, the key blade 102 has a top code pattern with cut out portions 103 at its upper edge, e.g. of a conventional type, cooperating with a central row of locking tumblers 205.

In accordance with the present invention, the key blade is also provided with a side code pattern with side code portions 104 of a special kind, similar to those disclosed in the above mentioned US patents to Widén. This side code pattern is formed by a continuous, generally wave-like guiding surface which cooperates with a row of side locking tumblers 206 (five in the row) when the key blade 102 is inserted into the key slot 201 of the lock 200.

The side locking tumblers 206 are each mounted in an associated chamber 207 (see also FIGS. 2, 3 and 4) for elevational and rotational movement therein. Each side locking tumbler 206 has a transversely projecting finger 208, which reaches into the key slot 201 and which will perform a pivotal movement when the side locking tumbler rotates in the cavity 207. Actually, when the key blade is inserted into the key slot 201, the finger 208 of the side locking tumbler will engage with the guiding surface and the code portions 104 of the key blade, so as to cause an elevational as well as a rotational movement back and forth of the side locking tumbler 206.

Figure 2:
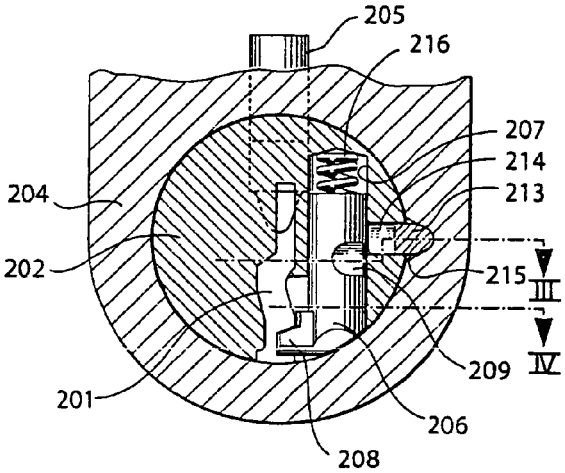
FIG. 2 shows a partial cross-section through the lock along the line II-II in FIG. 1.

The side locking tumbler 206 is provided with a pair of recesses 209,210 in its cylindrical surface at the back part (opposite to the finger 208). One of these recesses, 209, is visible in FIG. 2, and both of them are visible in FIG. 3. Between these recesses 209,210, there is a bridge portion 211, which fits into a corresponding recess 212 in a side bar 213 serving as a locking means or fence member. The side bar 213 is mounted in a slotted recess 214 in the key plug 202 adjacent to the outer cylindrical surface thereof. It is springloaded radially outwardly so as to be normally seated in a corresponding groove 215 in the lock housing 204, as shown in FIG. 2. In this position, the side bar 213 will effectively prevent the key plug from being rotated in relation to the housing 204.

However, if and when all the side locking tumblers 206 are correctly positioned, upon inserting a key with a correctly coded key blade 102 into the key slot 201, the bridge portions 211 will align with the associated recesses 212 in the side bar 213, whereby the latter can be moved radially inwards. Such inward movement can be effected by turning the key blade while the latter is located in its fully inserted position, so that the flank portions of the groove 215 displace the side bar radially inwards into the slotted recess 214. Now, the key plug 202 can be rotated within the housing 204, provided of course that any other locking mechanism, such as the central row of locking tumblers 205, is also released.

So, when the key blade 102 is being moved further into the key slot 201, the side locking tumblers 206 will be rotated back and forth, because of the engagement of the fingers 208 with the guiding surface of the key blade 101 and, at the same time, they will also perform a movement upwards and downwards. The finger 208 is subjected to a downwardly directed force and is kept in sliding engagement with the guiding surface by means of a helical spring 216 mounted so as to be compressed between the upper surface of the side locking tumbler 206 and an internal upper wall of the chamber 207.

The side code pattern with the code locations 104 is constituted by a generally wave-like guiding surface 105 which includes a ramp surface 106 adjacent to the free end portion 107 of the key blade 102. When the key blade 102 is inserted into the key slot 201, the ramp surface will engage successively with the respective finger 208 of each side locking tumbler 206 and will pivot and lift the latter so that the finger 208 subsequently slides along the wave-like guiding surface 105. In doing so, the finger 208 will follow the wave-like guiding surface 105 upwards and downwards, i.e. elevationally, while following the inclined surface portions of the guiding surface 105. It will also perform a pivotal or swinging movement back and forth so as to bring about a rotational movement of the side locking tumbler 206.

Figure 3:
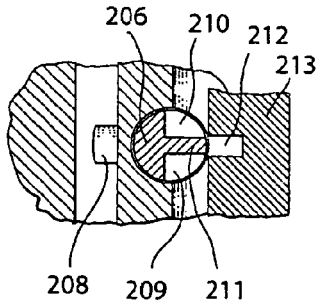
FIG. 3 shows a cross-sectional portion of the lock, in particular a side locking tumbler seen from above, along the line III in FIG. 2.
Figure 4:
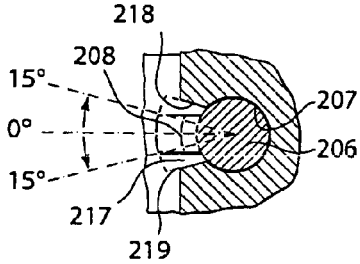
FIG. 4 shows a another cross-sectional portion of the lock, through the side locking tumbler having a projecting finger, along the line IV in FIG. 2.

As shown in FIGS. 3 and 4, there is a channel 217 leading from the lower part of the cavity 207 into the key slot 201, and the side walls of this channel constitute abutment surfaces 218, 219 which will limit the pivotal movement of the finger 208 in each direction from a central plane. In the illustrated example, the abutment surfaces 218,219 are located in such a manner that the movement will be limited to 15° in each direction, i.e. the finger can swing back and forth in an angular sector of 30° in this embodiment.

Figure 5:
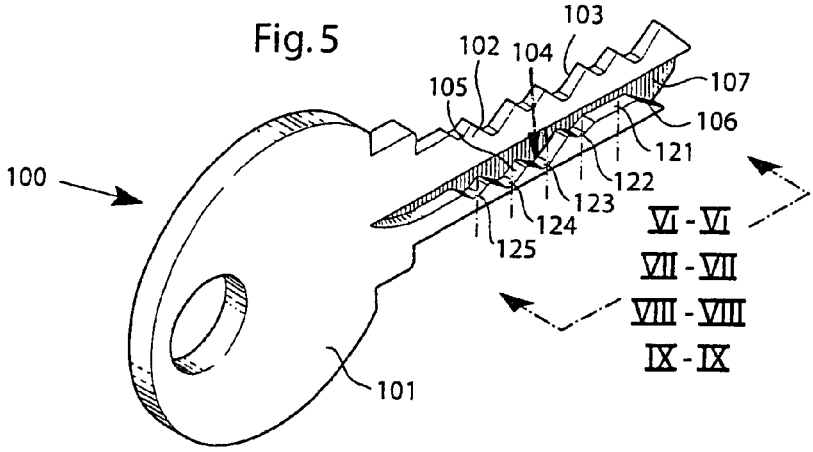
FIG. 5 shows in a perspective view a key blade having a wave-like side code pattern according to the invention.

The structure and function of the lock and key described so far is basically previously known from the above-mentioned documents. As illustrated in FIG. 5, a key 100 of this kind (identical to the one shown in FIG. 1), with a code pattern 105 has five code portions 121,122,123,124,125. Each such code portion is located in a longitudinal position corresponding to the longitudinal distribution of the side tumblers 206 (FIG. 1), although possibly displaced a small distance corresponding to the position of the free end of the finger 208 when being pivoted into either one of the angular end positions. The code portions 122,123,124,125 each form a concavity being located between two adjoining inclined or sloping surface portions which will assist in positioning the respective finger into a specific pivotal position when the key 100 has been fully inserted into the key slot 201 of the lock.

As described in the above-mentioned patents, this will provide a code which includes a great number of combinations, since the code involves different elevational positions as well as different pivotal positions for each finger, viz. six such combinations for each tumbler in the example discussed above (making a total of 6×6×6×6×6=7776 code combinations if all six code portions are of the same kind).

However, in order to provide for an increased number of code locations and an increased security against copying the key blade and picking the lock, the guiding surface 105 constituting the side code pattern with its code portions 104 is formed in a special way in accordance with the present invention. To illustrate this, reference is made to FIGS. 5 through 9, showing some modified code patterns at the side of the key blade. In these examples, one or more of the code portions of the guiding surface 105 is not formed as a concavity, which adjoins two inclined surface portions, but rather as a side code top segment forming part of the upper, straight surface, denoted a shelf surface, defining the upper boundary of the material region in which the code pattern has been cut out.

Figure 10:
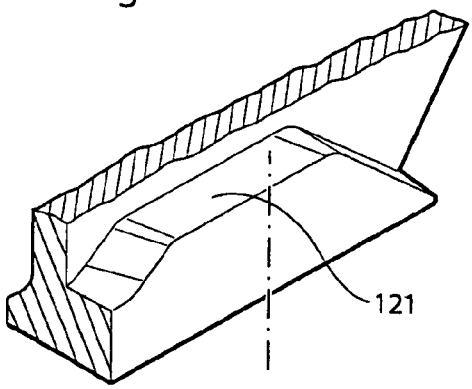
FIGS. 10 through 14 show, in an even larger scale, cut-out portions of some side code top segments according to the present invention.

The side code top segment may be so long in the longitudinal direction that, upon fully inserting the key blade into the key slot, the finger of the associated side locking tumbler can be pivoted to any angular position while remaining in contact with the side code top segment. Such a substantially flat side code top segment, denoted with the reference numeral 121, is shown in FIGS. 5 and 10.

Figure 6A:
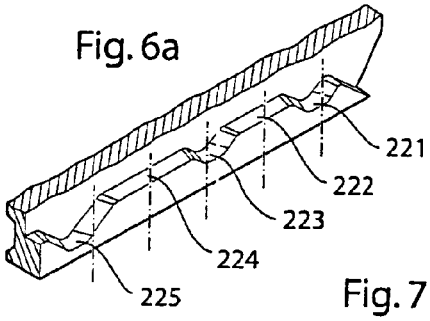
FIGS. 6*a*, 7*a*, 8*a*, 9*a* and 6*b*, 7*b*, 8*b*, 9*b* show, in perspective and side views, respectively, enlarged cut-out portions of the key blade of FIG. 5, with some possible variations of the side code pattern.
Figure 6B:
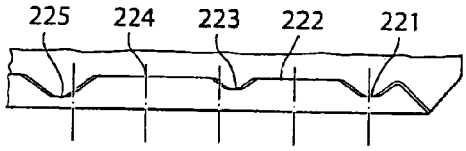

In the embodiment shown in FIGS. 6*a* and 6*b*, the generally wave-like guiding surface, which includes the ramp surface 106 at the free end portion of the key blade, comprises three "regular" concavities, 221, 223 and 225 but also two longitudinally extended, side code top segments 222 and 224. When the associated finger engages these side code top segments, the finger 208 (FIG. 2) can take any pivotal or angular position (see FIG. 4) while remaining at the same elevational level. However, as explained above, the finger will automatically be positioned in a pivotal end position pointing towards the free end or tip of the key blade.

So this elevational level in itself forms a specific code, this code being additional to the "concavity codes" already existing for the particular tumbler. In this way, there is at least one more possible code location in addition to the previously mentioned ones, e.g. seven possible code locations instead of six code locations. Accordingly, the total number of possible code combinations will be 7×7×7×7×7=16807 in this particular example.

In general, the number of such side code top segments can be zero, one, two, three, four or five in this embodiment with five tumblers and seven possible code locations for each tumbler.

Figure 7A:
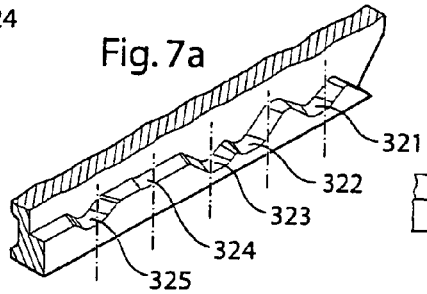
Figure 7B:
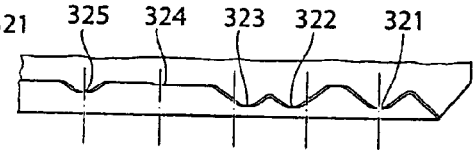
Figure 8A:
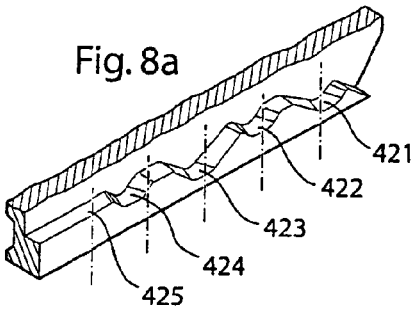
Figure 8B:
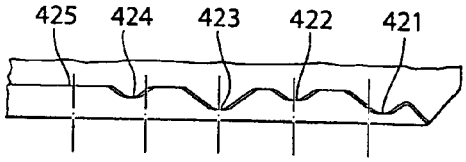
Figure 9A:
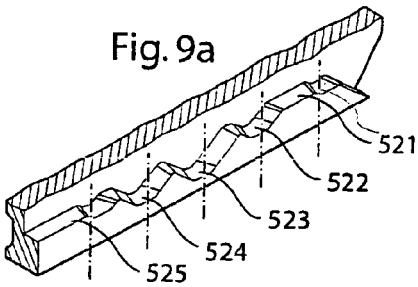
Figure 9B:
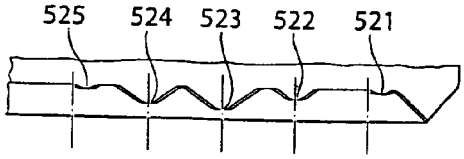

Some further examples are shown in FIGS. 7*a*, 7*b* (with one side code top segment 324, in addition to the concavities 321,322,323 and 325), FIGS. 8*a*,8*b* (also with one side code top segment 425, in addition to the concavities 421,422,423 and 424) and FIGS. 9*a*,9*b* (with two side code top segments 521,525 and three concavities 522,523,524).

The side code top segment can be formed in several different ways. As illustrated in FIG. 10 (and also in FIGS. 1 and 5), it can be formed by a continuous, straight, longitudinally extended surface portion 121 extending in parallel with the lower edge of the key blade.

Figure 11:
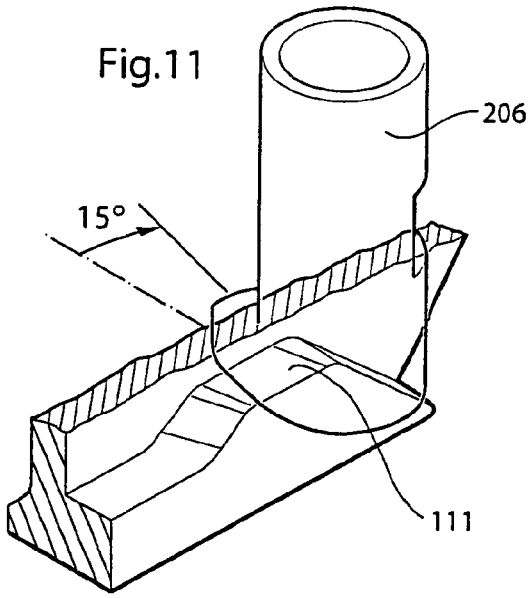

Alternatively, as illustrated in FIG. 11, the side code top segment can be formed as a relatively short supporting surface portion 111, possibly adjoining a shallow recess. This relatively short surface portion will hold the finger 208 (on the tumbler 206) in a pivotal end position abutting the abutment surface 218 (FIG. 4). When inserting the key blade into the key slot, the fingers 208 of the side locking tumblers will generally be swung into such pivotal end positions, by way of the frictional engagement from the wave-like guiding surface.

As explained above, when the key blade has been fully inserted into the key slot, the fingers of the side locking tumblers will remain in these pivotal end positions. Therefore, there is no real need to hold the finger in place by means of any sloping or stopping surface portions.

Figure 12:
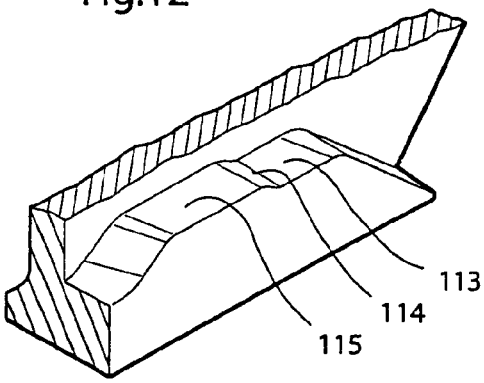

Nevertheless, it is possible to achieve such guidance or support by providing an end portion 113 at a slightly lower level or a shallow recess, which smoothly adjoins, at a curved portion 114, the main straight surface portion 115 of the side code top segment, as shown in FIG. 12.

Figure 13:
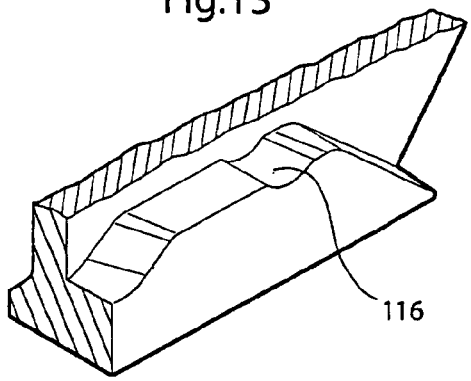

In FIG. 13, there is a shallow recess 116 located at an offset position to the right and serving to resiliently stop the pivotal movement in both directions.

Figure 14:
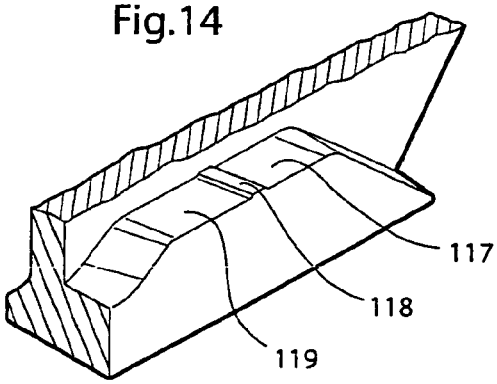

Still another possibility, as shown in FIG. 14, is that the side code top segment includes an upward projection 118 formed by two recess portions 117, 119 located on both longitudinal sides thereof.

The code patterns and the possible locations of the code portions are illustrated schematically in FIG. 15. Here, it is clearly shown that the finger 208 of each side locking tumbler 206 can be positioned in seven distinct code positions, namely corresponding to six differently located concavities (three pivotal positions, each at two different vertical levels) and the extra top code location discussed above. The three pivotal positions of the fingers 208 are shown in FIG. 15, in cross-sectional views, and in FIGS. 16 through 18, in perspective views.

It is to be noted that, for a particular pivotal position of the finger in a code location, the bridge portion 211 located between the recesses 209,210, at the rear cylindrical surface of the side locking tumbler 206, is positioned centrally so as to align with the recesses 212 in the side bar 213 (FIG. 3). Of course, these recesses and bridge portions 211 should also be located at a vertical position adapted to the vertical level of the corresponding code position at the key blade 102. For a side locking tumbler 206' (FIG. 19) adapted to cooperate with a side code top segment at the extra top code level, where the finger may be located at any pivotal position, the recesses at the rear surface of the tumbler may be formed as a unitary recess 209' which can accommodate the side bar irrespective of the rotational position of the tumbler 206'.

Of course, these seven different code positions or code portions can be a higher or a lower number. However, in standard keys as used in large numbers today, the illustrated embodiment is typical and constitutes a very practical example. The vertical extension of the key blade, perpendicular to the longitudinal direction thereof, is about 8.6 mm (about 0.34 inches), whereas the vertical extension or height of the side material region, where the particular guiding surface is cut out, is about 2.2 mm (within an interval of 2.0 to 2.5 mm). The height of the shallow recesses in FIGS. 11 to 14 is about 0.2 mm (within an interval of 0.15 to 0.25 mm).

Figure 20:
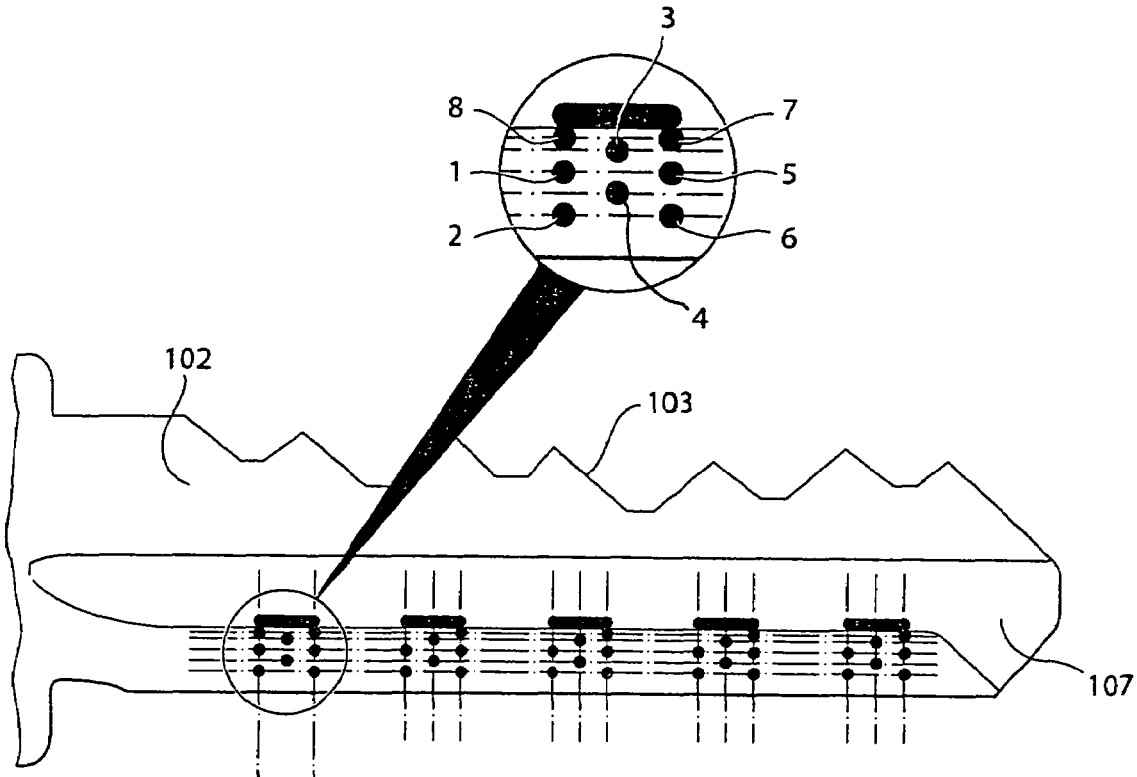
FIG. 20 shows a schematic side view, similar to that of FIG. 15, of a key blade of a modified embodiment of the lock and key system.
Figure 20:
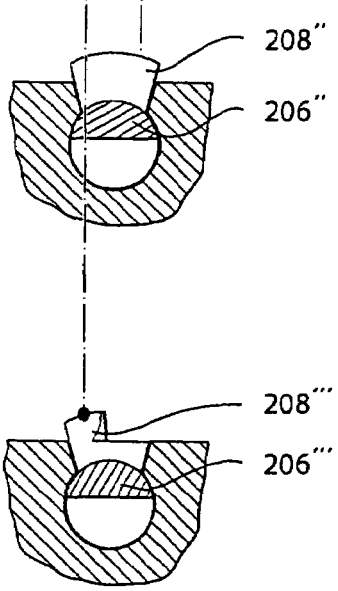
Figure 21:
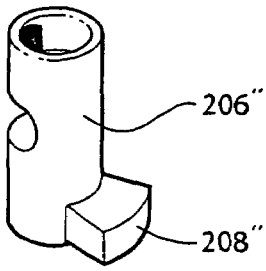
FIGS. 21 and 22 show, in perspective views, side locking tumblers for use in a lock cooperating with the key blade of FIG. 20.
Figure 22:
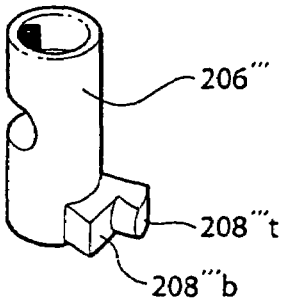

Even with the above-mentioned dimensions of the key blade and the vertical extension of the side material region where the wave-like guiding surface is formed, it is possible to even further increase the number of code locations to eight for each side tumbler. This is illustrated in FIGS. 20-22. Here, the system includes locks having a non-rotatable side tumbler 206" (FIG. 21) or 206'" (FIG. 22). Such locks having one or more non-rotatable tumblers (or tumblers with very limited capability of rotation) can be used in systems including other locks having rotatable side tumblers only. In this way, an eighth code location can be obtained at the rear end portion of the side code top segment. In FIG. 20 (the enlarged schematic view at the top to the right) this rear end portion is denoted "8" (top left), whereas the other seven code locations are denoted "1" through "7". The code location "8" would correspond to the segment portion 115 in FIG. 12.

The finger 208'" of the non-rotatable tumbler 206'" (FIG. 22) has a base portion 208'"*b*, which occupies a 30° angular sector and thus prevents rotation (see FIG. 4), and a narrow tip portion 208'"*t*, which is displaced towards the front side of the lock (see FIG. 1) so as to engage with a key blade side code top segment portion displaced away from the tip of an inserted key blade.

In the same system of locks and keys, locks with tumblers 206" as shown in FIG. 21 can also be used. These tumblers 206" have a finger 208" which is broad (30°) all the way from the base portion to the free end or tip portion. Such a finger will cooperate with both code locations "7" and "8", and possibly also with other code locations or with slope portions of some or all of such other code locations.

Because the code location "8" on the key blade is positioned at the highest or nearly highest level, there is a very small or no slope at all that will guide the finger towards the code location "8" during insertion of the key blade into the lock. That is why it is necessary to restrict the pivotal position of the tumbler finger to a limited pivotal angle (e.g. less than 5 or 10 degrees) in the vicinity of the location "8", or to block it completely against pivoting at this position (as shown in FIGS. 20-22).

It is true that such specially formed tumbler fingers, being non-pivotable or pivotable only within a small angular region, may be observed by sophisticated inspection through the key slot (201 in FIG. 1) of the lock. To discourage, to avoid or even make it impossible to precisely determine if and where such a tumbler is placed in the lock, such tumblers should be selectively used also in other code locations, such as in the locations "1" or "2", and possibly also in the locations "3", "4", "5", "6" and "7". In the locations "3", "4", "5", "6", and "7", the tumbler fingers may possibly be shaped so as to orient their key contacting surface in an angular direction towards the respective code location.

Through the use of the code location "8", possibly in combination with a correspondingly adapted tumbler, it would also be possible to cut a code location "7", "5" or "6" adjacent to the code location "8" (i.e. a double cut) for any one of the (five) tumbler positions. Such a key would then open a lock with code location "8" but also another lock with the particular code location "7", "5" or "6". With double cuts, it is of course possible to provide master keys capable of opening a number of different locks.

Figure 23:
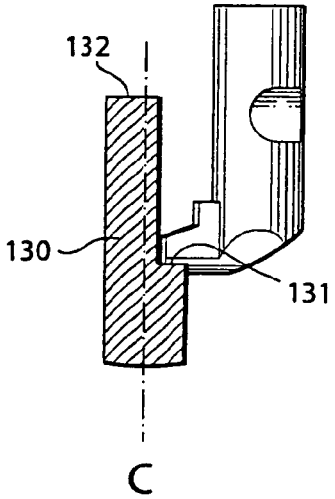
FIGS. 23, 24, 25, 26 and 27 show, in cross-sectional views, a number of possible key blade profiles that can be used in connection with the present invention.

As shown in FIGS. 23 through 27, the longitudinally extended shelf surface, which defines the upper limit of the guiding surface and may partially form one or more side code top segments, can be formed in different ways. In FIG. 23, this surface 131 is located below the upper edge portion 132 of the key blade 130. The shelf surface 131 stands at right angle to the central plane C of the key blade in this case.

Figure 24:
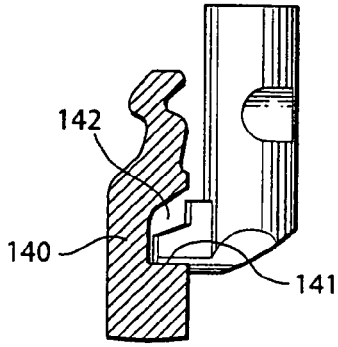

In FIG. 24, the shelf surface 141 is a lower wall of a side groove 142 in the key blade 140, this lower wall likewise standing at right angle to the central plane of the key blade.

Figure 25:
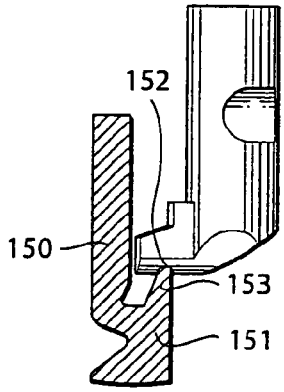

In FIG. 25, the key blade 150 has a widened lower portion 151, and the shelf surface 152 is in this case formed at the upper end portion of an upwardly projecting, longitudinally extending tongue or lip 153.

Figure 26:
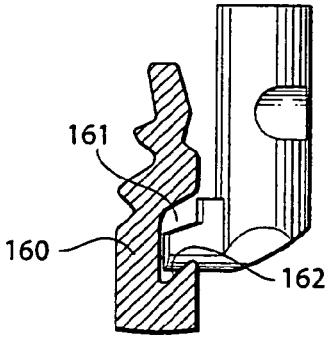
Figure 27:
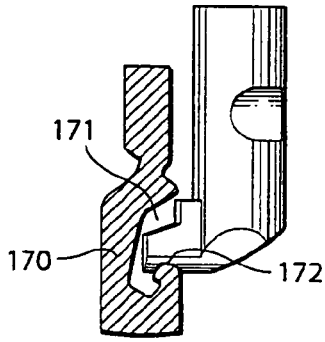

In FIG. 26, the shelf surface 162 is formed by the lower side wall portion 162 of an undercut groove 161, the lower bottom wall portion 162 being undercut, so as to form an acute angle and facing inwardly towards the bottom portion of the groove. A similar, but more complex shape of the undercut groove 171 of the key blade 170 is shown in FIG. 27, the surface area being denoted 172 in this case.

The lock and key system according to the invention may be modified by those skilled in the art. As indicated above, not all tumblers in a lock need to be rotatable. The number of side locking tumblers in a row may be different, e.g. only two tumblers in the row or any desired number, even higher than five, and the number of code levels may also be chosen at will (if more code levels are used, the height of the material region should be increased). The number of pivotal positions of the fingers may be less than three, e.g. only two, or more than three, e.g. four or five. The angles of the pivotal end position may be different. There may be one side code pattern on each side of the key, and possibly no top code pattern (103 in FIG. 1). Also, the profile of the key may be varied in many ways.

What is claimed is:

1. A key comprising:

a longitudinally extending key blade (102), which is insertable into a key slot (201) of a key plug of an associated lock, said key blade having a side material region at one side of said key blade defined upwardly by a longitudinally extending shelf surface, which is at least partially interrupted by a side code pattern cut into said material region so as to form a wave-like guiding surface (105) including a ramp surface portion (106) at the free end portion (107) of the key blade, said wave-like guiding surface (105) being adapted to engage with a finger of at least one side locking tumbler of said associated lock and making said finger follow said wave-like guiding surface, while the side locking tumbler is moved elevationally and rotationally and the finger (208) is caused to pivot sideways between pivotal end positions, when the key blade is inserted into the key slot, said wave-like guiding surface including at least one side code portion (122,123,124,125) associated with said side locking tumbler (206) and guiding the finger (208) thereof, upon fully inserting the key blade into the key slot, into a specific position, said at least one side code portion (122,123,124,125) being located at a selected one of a predetermined number of vertical code levels, being situated below said shelf surface, and at a selected one of a predetermined number of longitudinal positions, being defined by concavity configurations having adjacent sloping portions of said wave-like guiding surface, characterized in that in addition to said number of vertical code levels for said at least one side code portion, there is an extra code level located near said shelf surface at a higher level than said concavity configurations, and there being provided at least one extra side code portion in the form of a longitudinally extending, extra side code segment (121) located at this extra code level, said extra side code segment having a predetermined length for forming a substantially flat supporting surface portion with sufficient friction to position and retain, upon fully inserting the key blade into a lock, the associated finger in a correct pivotal orientation, corresponding to one of said pivotal end positions of the finger, pointing obliquely towards said free end of the key blade, whereby the number of possible code combinations is increased.

* * * * *